US005309848A

United States Patent [19]

Santelmann et al.

[11] Patent Number: 5,309,848

[45] Date of Patent: May 10, 1994

[54] REVERSIBLE, WEAR-RESISTANT ASH SCREW COOLER SECTION

[75] Inventors: Kenneth L. Santelmann, Guilford Twp., Medina County; Avelino G. Bolumen; Roger A. Clocker, both of Wadsworth; Thomas L. Garabedian, Stow; Donald C. Housley, Barberton; Russell A. Stanley, Green; James M. Tanzosh, Silver Lake, all of Ohio

[73] Assignee: The Babcock & Wilcox Company, New Orleans, La.

[21] Appl. No.: 953,631

[22] Filed: Sep. 29, 1992

[51] Int. Cl.[5] ..... F23J 1/02

[52] U.S. Cl. ..... 110/171; 110/165 R; 126/243

[58] Field of Search ..... 110/165 R, 171; 126/242, 243

[56] References Cited

U.S. PATENT DOCUMENTS 1,365,781 1/1921 Hartnett ..... 126/242
5,188,043 2/1993 Trepaud ..... 110/346

OTHER PUBLICATIONS

"Triten Overlay Product Systems"-Brochure From Triten Corporation of Houston, Tex.-Date Unknown-8 pages.

"Ash Cooling in Fluid Bed Boilers Can Ash Coolers Take the Heat?"-Paper No. 4102-Ash Cooling-Denver Trefoil, Apr. 1990-Novoselac & Wagner-pp. 11-1-8-Also Presented at Cibo Fluid Bed V Conference, Dec. 11-12, 1989-Sacramento, Calif.

*Primary Examiner*—Edward G. Favors
*Attorney, Agent, or Firm*—Eric Marich; Robert J. Edwards

[57] ABSTRACT

A reversible, wear-resistant ash screw cooler section is provided with a carbon steel inner liner having a high chrome, high carbide overlay emplaced thereon to improve its wear and erosion resistance. To facilitate obtaining the maximum wear out of the section, the replaceable section is made symmetrical about its vertical and longitudinal centerline and provided with suitable compatible flanges and symmetrically placed cooling water hookups on the ends of the section to allow the section to be reversed, end for end, and reconnected to the ash screw cooler.

3 Claims, 4 Drawing Sheets

REVERSIBLE, WEAR-RESISTANT ASH SCREW COOLER SECTION

BACKGROUND OF THE INVENTION

1. Field of the Invention

The present invention relates to the field of circulating fluid bed boilers (CFB's) such as those used in the production of steam for industrial process requirements and/or electric power generation and, in particular, to a reversible, wear-resistant ash screw cooler section which provides extended service life.

2. Description of the Related Art

A fluidized bed boiler, as used in the context of industrial processes and/or utility power generation, is similar to a water-filled container. Instead of water, however, the material in the bed is a congregation of granular solid particles (fuel and sorbent, such as limestone) in a state of mobile suspension as a result of the upward flow of air or gas. Initially, the bed's individual solid particles or granules are motionless and supported by contact with each other. The material as a whole rests on what is known as a distributor plate or grid plate, which has openings in it to permit the upward flow of air or gas therethrough, as well as drains for waste material.

As the rate of upward air or gas flow through the distributor plate is increased, the individual particles or granules within the bed will begin to move. In a non-circulating or bubbling bed type of fluidized bed boiler, the flow rate is increased until the fluidization point is reached. The term fluidization point denotes that point where the air or gas flow upward through the bed expands the solid bed sufficiently to allow the granules to move within the bed. That is, this is a condition where the individual particles or granules of solid are suspended by the air or gaseous fluid passing through them at a velocity sufficient to cause them to be disengaged somewhat from each other. The air or gas flow upward through the bed determines the amount and size of voids between the particles, and the overall level of the fluidized bed is determined by the amount of particles, that is, fuel, inerts, etc. in the bed as expanded/fluidized by the air or gas flow. The upward flow rate of air or gas is maintained at a level to maintain the bed at the fluidization point, and to minimize any transport of particles out of the bed into the upper furnace area.

In contrast, a circulating fluid bed boiler is maintained with upward air or gas flows which exceed the fluidization point, which results in particles being carried out of the bed into the upper furnace area. FIG. 1 is a sectional side view of one such CFB boiler design of The Babcock & Wilcox Company, the Ebensburg Power unit located in Ebensburg, Pa. This boiler burns waste bituminous coal to produce, at maximum continuous rating (MCR), 465,000 lb/hr main steam flow at 955° F. and 1550 psig. The high fuel ash content at this unit (40% design maximum) produces furnace circulating solids with a much higher percentage of ash than with a typical bituminous coal, and leads to severe erosion problems.

As shown therein, the boiler has a furnace enclosure that is top-supported from structural steel and is constructed of gas-tight membrane walls. Coal and limestone (for sulfur dioxide removal) are fed through the furnace front wall using four injection screws. Combustion air from a single forced draft fan is split downstream of the air heater into primary and overfire air.

The primary air is introduced into the bed through the furnace floor from a compartmented windbox, while the overfire air enters the lower portion of the furnace through different size nozzles at two elevations on the front and rear walls. Adjustment of these two air streams provides proper air distribution and air-gas mixing to achieve fuel burnout in the furnace.

The solids handling system for the Ebensburg unit is shown schematically in FIG. 2. Located above the furnace I is the primary solids collector; an impact-type separator consisting of a staggered array of U-shaped elements (U-beams) 9, 10 hung from the boiler roof forming a labyrinth passage for gas and solids. The first two rows of the primary collector, i.e., the in-furnace U-beams 9, are located just upstream of the furnace outlet where they discharge collected material directly into the furnace I along the rear wall. The solids collected by the other rows 10 of the primary collector are discharged into a particle storage hopper and returned to the lower furnace through four non-mechanical L-valves 11.

The total solids inventory in the bed is controlled by removing the bed material through four bed drain pipes 2 installed in the furnace floor and water-cooled screw coolers 3. The screw coolers 3 take ash from the fluidized bed at temperatures in the range of 1600° F. and cool it to approximately 450° F. The bottom ash is routed through a rotary valve 7 to a screening device 4 where the fine material is separated and pneumatically conveyed in dense phase transport 5 to a bed drain injection bin 6 located on the boiler front wall.

The solids flow control by L-valves 11 allows exchanging of the solids inventory between the furnace I and particle storage hopper for the furnace process control. The two-stage primary collector arrangement 9, 10 reduces the amount of external recycle needed to maintain the furnace inventory. Solids escaping the primary collector 9, 10 into the convection pass enter the multiclone dust collector (MDC) 13 located between the economizer and the air heater 17. Solids collected by the MDC are recycled to the lower furnace via a dilute phase pneumatic recycle system 14, 15. Excessive solids are purged from the MDC hopper 13, while solids leaving the air heater 17 are collected in a baghouse 18.

Cooling the ash drained from the bed has required fluid bed ash coolers, ash screw coolers, or both. One type of ash screw cooler 20 is known as a HOLO-FLITE$^R$ ash screw cooler, manufactured by Denver Equipment Company, Colorado Springs, Colo., and a sketch of same is shown in FIG. 3. The drive 22 for the ash screw cooler 20 is generally a variable speed type, and can be controlled by the plant control system (not shown) using a signal developed from pressure drop across the fluidized bed. Primary cooling of the ash is achieved via the screw flites 26 themselves, which are hollow and circulate cooling water 28 therethrough. Typical cooling water pressures are 150 or 250 psig on the screw and 30 or 50 psig on the trough jacket 30. Because of the high ash temperatures, the entire feed end 24 of the ash screw cooler 20 must also be cooled, including the end plate 32, the first section of the trough cover 34, and feed nozzle 36.

The Ebensburg unit has experienced extreme erosion in the bed drain ash screw coolers. The erosion has been so severe that the inner liners of the troughs failed by wearing through after only a short period of time, resulting in water leaking from the trough. A replaceable end trough section, having an inner liner of ½ inch thick stainless steel, was retrofitted to these ash screw coolers, but failed to significantly reduce the time to failure even though the use of stainless steel liners in previous "high wear" situations had been successful.

It is thus apparent that a solution to this erosion problem concerning the ash screw coolers is required.

SUMMARY OF THE INVENTION

The purpose of the present invention is to prevent the ash screw cooler erosion failures described above. The solution should be easily retrofittable as a fix on existing units employing such ash screw coolers, as well as being suitable for implementation on new construction.

Accordingly, one aspect of the present invention is to provide a replaceable, wear-resistant ash screw cooler section for use in ash screw coolers which has, in a preferred embodiment, a ⅛ inch thick high chrome, high carbide overlay emplaced on the carbon steel liner of the trough to improve its wear and erosion resistance. This overlay is known commercially as TRITEN T-211 chromium carbide iron base overlay, as produced by the TRITEN Corporation of Houston, Tex.

Since wear patterns on the existing liners showed a decrease in wear with an increase in distance from the trough inlet end, another aspect of the present invention involves making the replaceable, wear-resistant ash screw cooler section reversible, end for end, so that it could be removed and reversed to allow wear on the opposite end. The replaceable section is made symmetrical about a vertical and longitudinal centerline, and provided with suitable compatible flanges and cooling water hookups on the ends of the section to allow the section to be reversed and reconnected to the rest of the ash screw cooler.

The various features of novelty which characterize the invention are pointed out with particularity in the claims annexed to and forming a part of this disclosure. For a better understanding of the invention, its operating advantages and specific results attained by its uses, reference is made to the accompanying drawings and descriptive matter in which preferred embodiments of the invention are illustrated.

DESCRIPTION OF THE PREFERRED EMBODIMENTS

Figure 1:
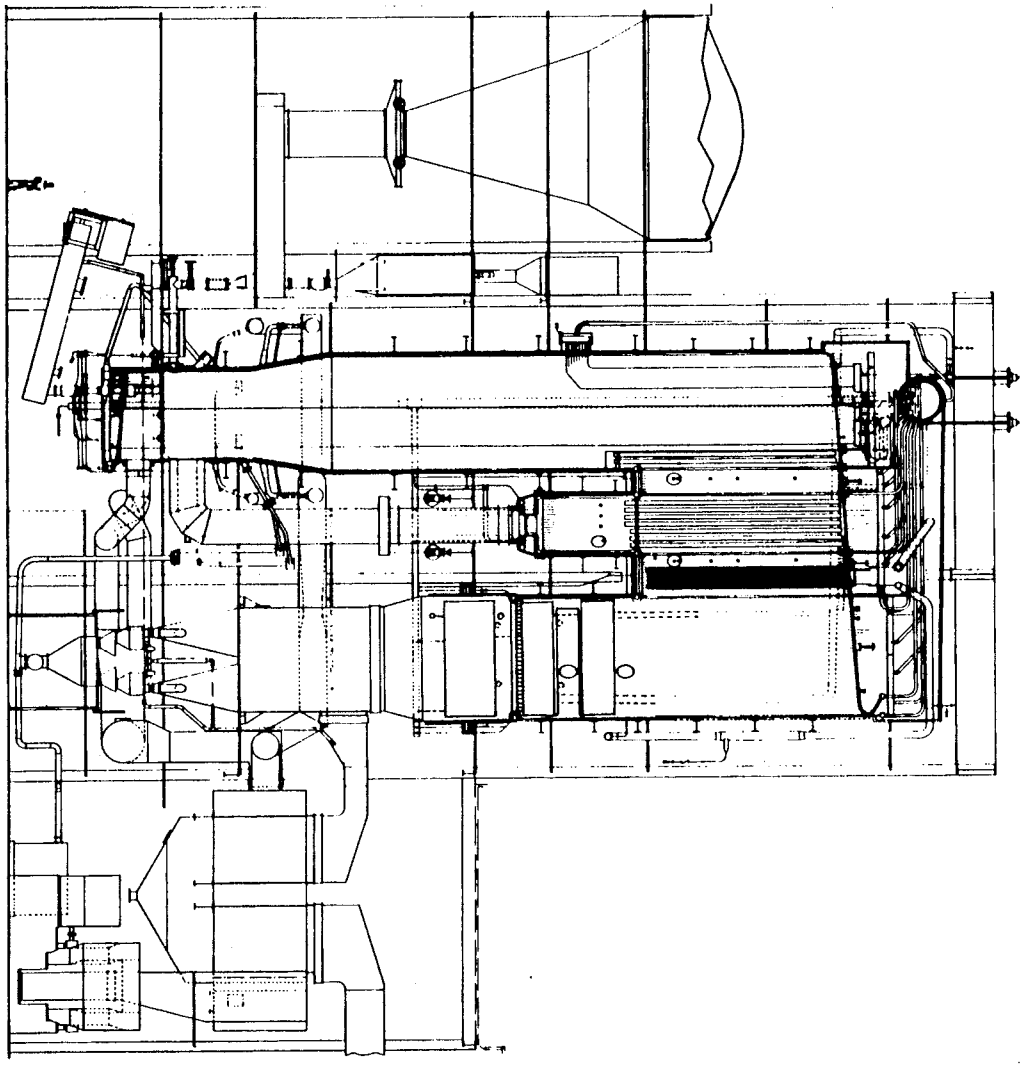
FIG. 1 PRIOR ART
FIG. 1 is a sectional side view of the Ebensburg Power CFB unit.
Figure 2:
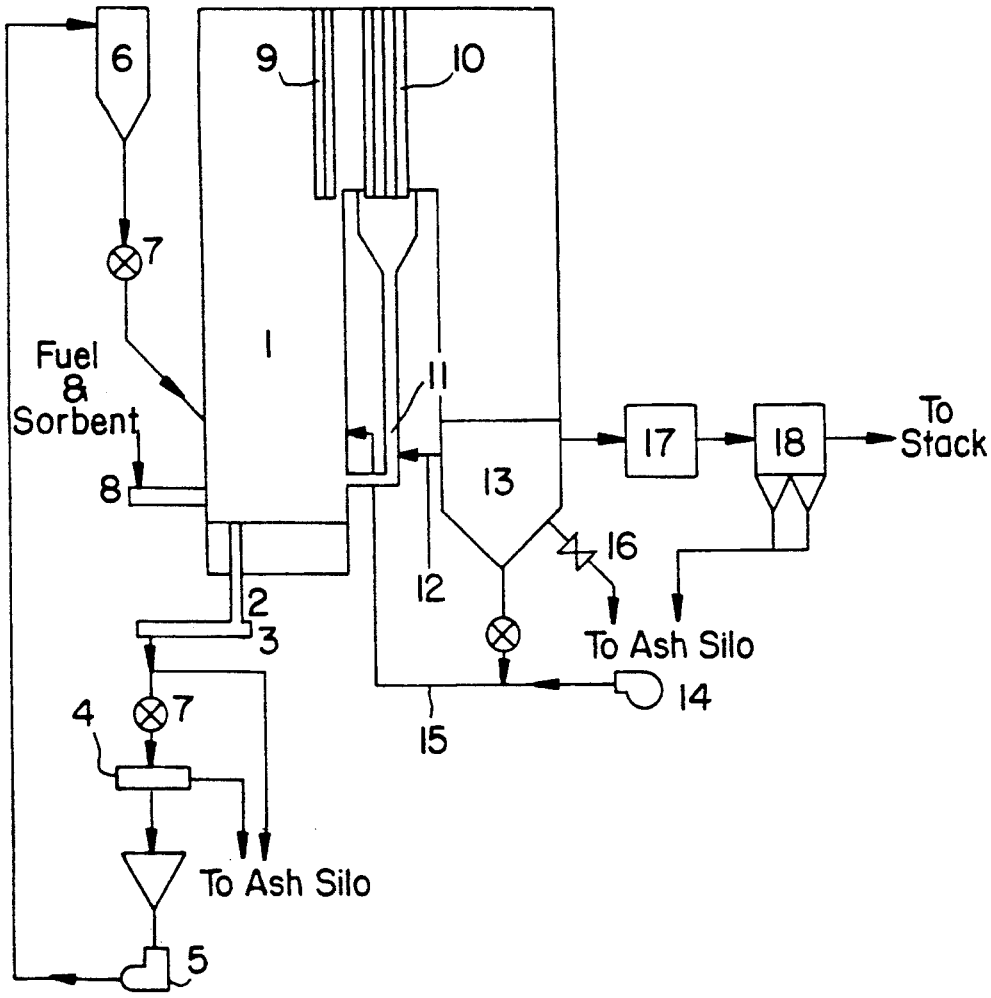
FIG. 2 PRIOR ART
FIG. 2 is a schematic view of the solids handling system of the Ebensburg Power CFB unit.
Figure 3:
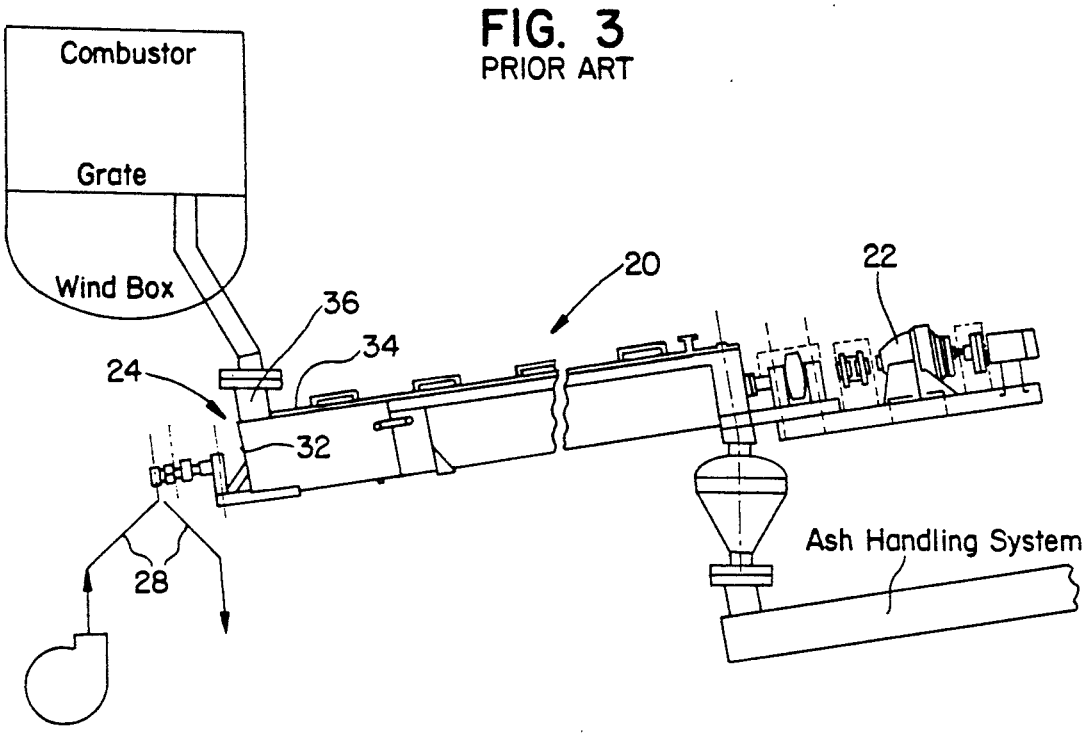
FIG. 3 PRIOR ART
FIG. 3 is a schematic of one type of ash screw cooler.
Figure 4:
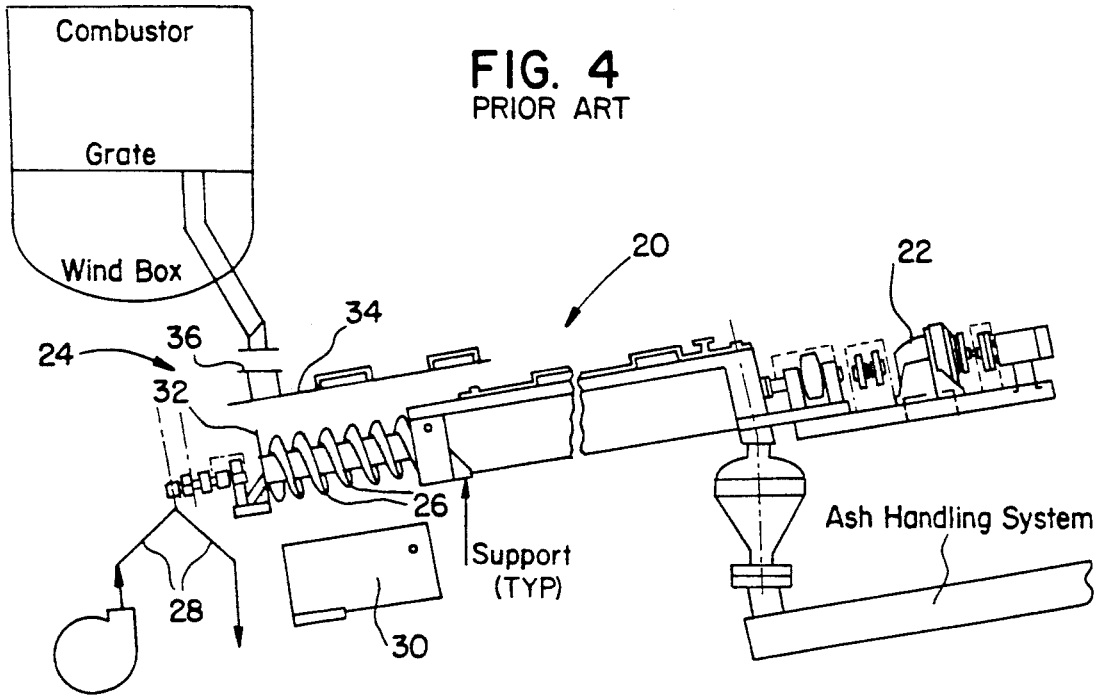
FIG. 4 PRIOR ART
FIG. 4 is a schematic view of another type of ash screw cooler wherein the inlet end is provided with a replaceable trough section.
Figure 5:
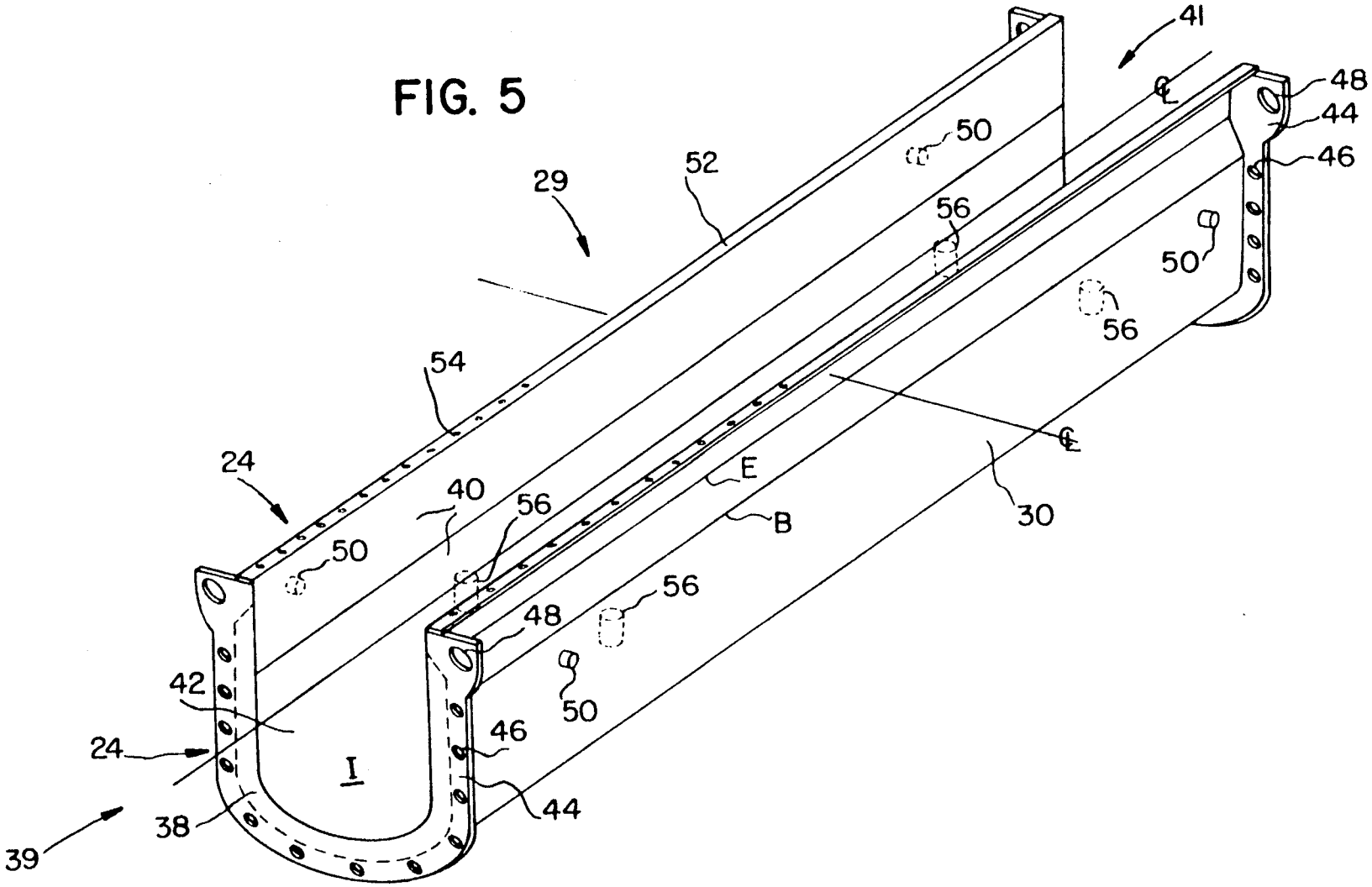
FIG. 5 is a perspective view of the reversible, wear-resistant ash screw cooler section according to the present invention.

Referring to the drawings generally, wherein like numerals designate the same element throughout the several drawings, and to FIG. 5 in particular, the invention embodied in FIG. 5 comprises a replaceable, wear-resistant ash screw cooler section 29 for the feed end of an ash screw cooler. The section 29 comprises a U-shaped, carbon steel liner plate 40 having a pair of identical, outwardly facing flanges 52 at each end of the U and a high chrome, high carbide overlay 42 emplaced on an inner surface I of the liner plate 40.

A U-shaped, carbon steel trough jacket 30 partially surrounds an outer surface of the U-shaped liner plate 40, is bent inwardly at two bend locations B, and is welded along a lateral edge E of the trough jacket 30 to the liner plate 40 to partially define a water jacket 38 therebetween which has a first end 39 and a second end 41.

A pair of flanged plates 44, one welded at each end 39, 41 of the water jacket 38, together with the U-shaped liner plate 40 and the trough jacket 30 serve to completely define the water jacket 38.

Finally, a plurality of cooling water hookups 50, 56 are symmetrically located on the trough jacket 30 near the ends 39, 41 of the ash screw cooler section 29, for providing cooling water to and from the water jacket 38.

In a preferred embodiment of the invention, the high chrome, high carbide overlay is a ⅛ inch thick TRITEN T-211 chromium carbide overlay, as manufactured by Triten Corporation of Houston, Tex. In particular, this overlay material has an alloy content of 39% consisting of Fe, Cr, C, Mn, Mo and Si. In the thickness of ⅛ inch, the typical hardness is 56–58 Rockwell C ($R_c$). It should be noted, however, that materials of similar hardness and composition provided by other manufacturers should provide the same enhanced resistance to wear.

Finally, the ash screw cooler section 29 is preferably provided with a pair of identical flanged plates 44 having apertures 46 and lifting lugs 48, to permit the ash screw cooler section 29 to be reversed end for end and attached to the ash screw cooler (not shown) to extend the wear life of the section 29 by allowing wear on the opposite end.

Design procedures for this structure would follow accepted engineering practice; using A.S.M.E. Section VTII Boiler and Pressure Vessel Codes as a guide for the selection of appropriate design temperatures and pressures.

While specific embodiments of the invention have been shown and described in detail to illustrate the application of the principles of the invention, it will be understood that the invention may be embodied otherwise without departing from such principles. By way of example, while a typical length of the ash screw cooler section 29 is approximately 6 feet long and 24 inches wide, other dimensions that correspond to a reasonable maintenance size can be employed. Similarly, while the invention has been shown and discussed in the context of a single screw within the ash screw cooler, it is entirely possible that multiple screws could be employed within a single screw cooler housing. All such modifications and embodiments have been omitted for the sake of conciseness and readability, but properly fall within the scope of the following claims.

What is claimed is:

1. A replaceable, wear-resistant ash screw cooler section for the feed end of an ash screw cooler, comprising:

a U-shaped, carbon steel liner plate having a pair of identical, outwardly facing flanges at each end of the U and a high chrome, high carbide overlay emplaced on an inner surface of the liner plate;

a U-shaped, carbon steel trough jacket partially surrounding an outer surface of the U-shaped liner plate and welded along a lateral edge of the trough jacket to the liner plate to partially define a water jacket therebetween which has a first and a second end;

a pair of flanged plates, one welded at each end of the water jacket, which, together with the U-shaped liner plate and the trough jacket serve to completely define the water jacket; and a plurality of cooling water hookups symmetrically located on the trough jacket near the ends of the ash screw cooler section, for providing cooling water to and from the water jacket.

2. The ash screw cooler section of claim 1, wherein the high chrome, high carbide overlay is a TRITEN T-211 chromium carbide iron base overlay, having an alloy content of 39% consisting of Fe, Cr, C, Mn, Mo, and Si with a typical hardness of 56–58 Rockwell C ($R_C$).

3. The ash screw cooler section of claim 1, wherein the pair of flanged plates are identical to each other to permit the ash screw cooler section to be reversed end for end and attached to the ash screw cooler to extend the wear life of the section by allowing wear on the opposite end.

* * * * *